United States Patent [19]

Bury et al.

[11] 4,409,930

[45] Oct. 18, 1983

[54] VENTING A LIQUID SUPPLY SYSTEM

[75] Inventors: Cecil T. Bury; Andrew J. Holmes, both of Huddersfield, England

[73] Assignee: David Brown Tractors Ltd., Huddersfield, England

[21] Appl. No.: 256,413

[22] Filed: Apr. 22, 1981

[30] Foreign Application Priority Data

Apr. 24, 1980 [GB] United Kingdom ..... 8013608

[51] Int. Cl.[3] ..... F02M 37/00

[52] U.S. Cl. ..... 123/514; 123/510

[58] Field of Search ..... 123/514, 510, 511, 512, 123/513, 516, 585, 472

[56] References Cited

U.S. PATENT DOCUMENTS

| | | | |
|---|---|---|---|
| 2,353,269 | 7/1944 | Roth et al. | 123/510 |
| 3,118,492 | 1/1964 | Stone | 123/514 |
| 3,548,796 | 12/1970 | Gastinne | 123/510 |
| 4,173,958 | 11/1979 | Kato et al. | 123/514 |
| 4,216,753 | 8/1980 | Inoue et al. | 123/472 |
| 4,279,232 | 7/1981 | Schuster et al. | 123/514 |
| 4,320,734 | 3/1982 | Balachandran | 123/514 |

FOREIGN PATENT DOCUMENTS

| | | | |
|---|---|---|---|
| 610248 | 10/1948 | United Kingdom | 123/514 |

*Primary Examiner*—Ira S. Lazarus
*Assistant Examiner*—Magdalen Moy

[57] ABSTRACT

A diesel engine may have an electrically-actuated cold starting device in its inlet manifold, gravity fed with fuel from a reservoir interposed in a pipe for returning excess fuel from the injectors and injection pump to the vented fuel tank. If the pipe opens below the fuel level in the tank because the latter is full, or if oil is retained in the pipe by capillary action when the tank is not full, air cannot reach the reservoir to permit fuel flow to the device when required. The reservoir outlet to the tank therefore includes a restriction from which fuel emerges as a jet while the engine is running, and a vent hole within the zone containing the jet. The velocity of the jet carries fuel past the vent hole without any loss of fuel through the latter. When the engine is not running, the vent hole connects the reservoir to atmosphere.

6 Claims, 1 Drawing Figure

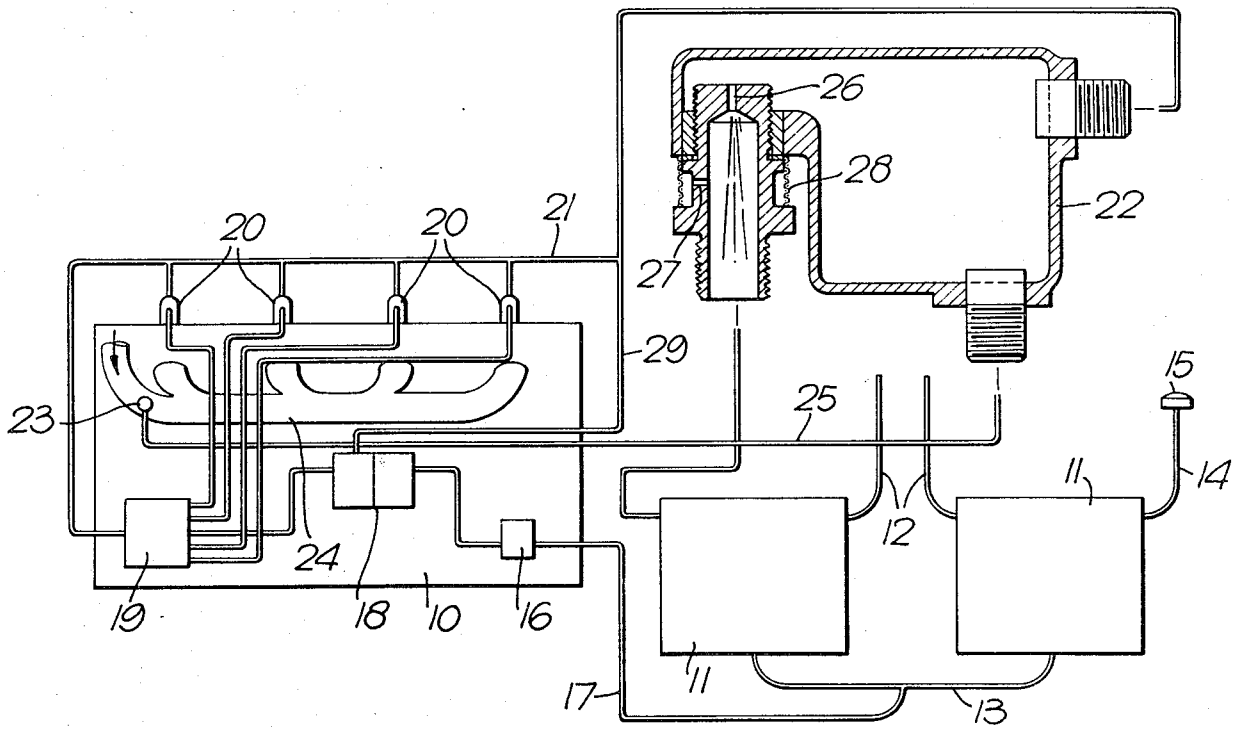
22
26
28
27
29
21
20
20
23
24
18
19
16
10
17
25
12
11
11
13
15
14

VENTING A LIQUID SUPPLY SYSTEM

BACKGROUND OF INVENTION

The invention relates to means for venting a liquid supply system to atmosphere without loss of liquid, particularly but not exclusively a fuel system including a cold starting device for an internal combustion engine.

It is known to provide a diesel-engined argicultural tractor with a fuel system comprising at least one vented tank, a diaphragm pump drawing fuel from the tank and supplying it by way of a filter assembly to a fuel injection pump which delivers it to injectors associated with respective cylinders of the engine, a leak line for returning excess fuel from the fuel injection pump and the injectors to tank, and a cold starting device in the inlet manifold supplied with fuel by gravity from an outlet in the lower part of a reservoir provided in its upper part with an inlet and an outlet by means of which it is interposed in the leak line. A restriction is provided in the leak line upstream of the reservoir, and the major part of the excess fuel may be returned directly from the upstream side of the restriction to the filter assembly to avoid the need for it to pass through the diaphragm pump more than once. A single tank disposed at a higher level than the engine, and two interconnected saddle tanks disposed at a lower level than the engine, have alternatively been employed. There are two reasons why such a system does not always permit the flow of fuel from the reservoir to the cold starting device when necessary. One reason is that when the tank or tanks is or are completely or almost full, the leak line opens below the fuel level therein and air from the tank vent cannot reach the reservoir to enable fuel to flow to the cold starting device. The other reason, which is particularly applicable to tanks disposed below and some distance from the engine, is that even when the tank or tanks is or are partially empty and the leak line opens into a vented air-space above the fuel therein, that part of the leak line between the reservoir and the tank retains oil by capillary action which prevent air from reaching the reservoir to enable fuel to flow to the cold starting device.

One solution to this problem has been to provide a non-return valve for positively venting the reservoir to atmosphere only when a flow of fuel to the cold starting device from the reservoir is required, at which time the system is unpressurised and loss of fuel through the temporary vent does not therefore occur. However, due to the low pressure available to hold the non-return valve closed whilst the engine is running, said valve requires extremely accurate setting.

The object of the present invention is to provide means for permanently and positively venting the reservoir to atmosphere without loss of fuel which require no setting and are very simple and cheap to produce.

SUMMARY OF INVENTION

According to one aspect of the invention, means for venting a liquid supply system to atmosphere without loss of liquid comprise a restriction from which liquid emerges as a jet and a vent hole disposed down-stream of the restriction within the zone containing the jet.

According to another aspect of the invention, a fuel system for an internal combustion engine comprises a diaphragm pump drawing fuel from a tank and supplying it to a fuel injection pump which delivers it to at least one injector, a leak line for returning excess fuel from the fuel injection pump and the injector to the tank, a cold starting device in the inlet manifold supplied with fuel by gravity from an outlet in the lower part of a reservoir provided in its upper part with an inlet and an outlet by means of which it is interposed in the leak line, and means according to the preceding paragraph disposed in that outlet leading from the upper part of the reservoir to the tank.

According to a further aspect of the invention, an agricultural tractor has a diesel fuel system according to the preceding paragraph including two interconnected saddle tanks.

BRIEF DESCRIPTION OF DRAWING

One embodiment of the invention will now be described, by way of example, with reference to the accompanying drawing which is a diagrammatic illustration of an internal combustion engine and its associated fuel system, that part of said system which is cross-hatched being shown on a much larger scale.

DESCRIPTION OF PREFERRED EMBODIMENT

Referring now to the drawing, an agricultural tractor has a multicylinder diesel engine 10 with a fuel system including two saddle tanks 11 with respective vents 12, the lowest points of said tanks being interconnected by a tube 13. One of the tanks 11 has a filler neck 14 which effectively serves both tanks and is provided with a cap 15. A diaphragm pump 16 driven by the engine's camshaft in well-known manner draws fuel through a pipe 17 from the lowest point of the tube 13 and supplies it by way of a filter assembly consisting of two paper cartridge-type filters 18 in series to a fuel injection pump 19 of rotary type which delivers it in a precisely timed sequence to injectors 20 associated with the respective cylinders. A leak line 21 is provided for returning excess fuel from the fuel injection pump 19 and the injectors 20 to one of the tanks 11, and a reservoir 22 is interposed in the leak line 21 with its inlet from and outlet to said line disposed in its upper part. The reservoir 22 accordingly remains full of fuel whilst the engine 10 is not running. A cold starting device 23 in inlet manifold 24 comprising the engine's induction system is supplied with fuel solely by gravity through a pipe 25 from an outlet in the lower part of the reservoir 22, and the fuel thus supplied is released, vapourised and ignited by electrical coil means in known manner when required. The reservoir 22 is permanently and positively vented to atmosphere to enable fuel to flow to the cold starting device 23 when required, without loss of fuel whilst the engine 10 is running despite the slight pressure which then exists in the leak line 21, by means disposed in that outlet leading from the upper part of the reservoir 22 to said one tank 11. Said means have no moving parts and simply comprise a restriction 26 from which fuel emerges as a jet and a vent hole 27 disposed downstream of the restriction 26 within the zone containing the jet. The velocity of the jet carries fuel past the vent hole 27 whilst the engine 10 is running without any loss of fuel through said hole. A nylon gauze filter 28 is provided externally of the vent hole 27 to prevent said hole from becoming blocked by dirt particles drawn in with the air when fuel flows from the reservoir 22 to the cold starting device 23. A pipe 29 connects that part of the leak line 21 upstream of the reservoir 22 to the second of the paper cartridge-type filters 18, and the back-pressure exerted by the restriction when the engine 10 is running causes the major part of the excess fuel to be returned directly to said second filter to avoid the need for it to pass through the diaphragm pump 16 more than once.

In another, basically similar embodiment, an in-line fuel injection pump is employed which requires a significant back-pressure in the leak line, and the pipe connecting the upstream side of the reservoir to the second paper cartridge-type filter is therefore omitted.

We claim:

1. A fuel system for an internal combustion engine comprising a pump drawing fuel from a tank and supplying it to a fuel injection pump which delivers it to at least one injector, a leak line for returning excess fuel from the fuel injection pump and the injector to the tank, a cold starting device in the engine's induction system supplied with fuel solely by gravity from an outlet in the lower part of a reservoir provided in its upper part with an inlet and an outlet by means of which it is interposed in the leak line, a restriction from which fuel emerges as a jet disposed in that outlet leading from the upper part of the reservoir to the tank, and a vent hole disposed downstream of the restriction within the zone containing the jet.

2. A fuel system according to claim 1, wherein a filter is provided externally of the vent hole to prevent said hole from becoming blocked by dirt particles drawn in with the air.

3. A fuel system according to claim 1 or claim 2, wherein a filter assembly is interposed in the connection between the pump and the fuel injection pump.

4. A fuel system according to claim 1 or claim 2, wherein fuel is returned from that part of the leak line upstream of the reservoir to the connection between the pump and the fuel injection pump.

5. A fuel system according to claim 3, wherein fuel is returned from that part of the leak line upstream of the reservoir to the filter assembly.

6. A fuel system according to claim 1 or claim 2, including two interconnected saddle tanks.

* * * * *